US006763777B1

(12) United States Patent
Rosenberg

(10) Patent No.: US 6,763,777 B1
(45) Date of Patent: Jul. 20, 2004

(54) CONVERSION COCKPIT FOR A SAILBOAT

(76) Inventor: Christian F. Rosenberg, 6370 Estate Frydendahl, Suite 20, St. Thomas, VI (US) 00802-1802

( * ) Notice: Subject to any disclaimer, the term of this patent is extended or adjusted under 35 U.S.C. 154(b) by 0 days.

(21) Appl. No.: 10/385,053

(22) Filed: Mar. 10, 2003

Related U.S. Application Data

(60) Provisional application No. 60/362,665, filed on Mar. 8, 2002.

(51) Int. Cl.[7] ..... B63B 3/00
(52) U.S. Cl. ..... 114/355; 114/357; 114/364
(58) Field of Search ..... 114/350, 355, 114/357–359, 363, 382

(56) References Cited

U.S. PATENT DOCUMENTS 4,723,928 A * 2/1988 Riley ..... 114/355
4,917,037 A * 4/1990 Hargett, Sr. ..... 114/357
5,481,998 A * 1/1996 Trent ..... 114/355

* cited by examiner

*Primary Examiner*—Jesus D. Sotelo
(74) *Attorney, Agent, or Firm*—James M. Deimen

(57) ABSTRACT

A new cockpit unit and method for installation in a sailboat comprises a drop-in replacement cockpit of fiberglass reinforced resin that increases cockpit floor area by 255% and converts Cruiser/Racer into a Day-Sailer/Racer. The conversion retains all aspects of the sailboat required by the racing rules but affords greater comfort and maneuverability for the skipper and crew. As applied to the J-24 class sailboat, the new cockpit and installation method retain the structural integrity of the hull by retaining the bulkheads of the hull supporting the cockpit floor.

16 Claims, 6 Drawing Sheets

CONVERSION COCKPIT FOR A SAILBOAT

This application claims the benefit of provisional patent application No. 60/362,665 filed Mar. 8, 2002.

BACKGROUND OF THE INVENTION

The field of the invention pertains to open cockpit sailboats usually used for day sailing pleasure. In particular, the invention pertains to improvements in cockpit size and arrangement within a specific class of sailboat used for both competition sailboat racing and family day sailing pleasure.

Over the past 100 years, a great number of small sailboats have been designed and constructed on a production basis for the pleasure of day sailing and racing. The production boats have generally been built to conform to defined classes with specific dimensional rules for hulls and sails, each class having a recognizable name and logo. Prior to the late 1930's, the hulls were made of wood planking and sails of cotton canvas. Beginning with the late 1930's and extending into the 1960's, plywood became a common hull material; however, fiberglass reinforced resin has revolutionized sailboat hull construction since the 1950's.

The advent of fiberglass reinforced resin construction has enabled naval architects and other sailboat designers to greatly expand the variety of possible hull shapes and cockpit configurations. However, for any given hull size and shape, the cockpit configuration is a compromise between the competing features for racing, cruising and for day sailing. Cockpits tend to be limited in size and uncomfortable in sailboats primarily intended for racing or cruising. Conversely, cockpits tend to be more generous and comfortable in sailboats primarily intended for day sailing.

The J-24 sailboat is a one-design cruising/racing sailboat in a class with strict rules to qualify for class sanctioned racing. With a length overall of 24' and a 8' 10½" beam, the J-24 as built has a very small cockpit with the bulk of the interior enclosed by deck. The J-24 is clearly fitted for racing with relatively little emphasis on cruising. The J-24, however, offers good possibilities for conversion to a day-sailer without disqualifying the boat under the class racing rules. With the size of the J-24 being at the upper end of practical size for a day-sailer, the J-24 offers the possibility of a commodious cockpit for several crew or day-sailing passengers.

SUMMARY OF THE INVENTION

The invention comprises a replacement cockpit as a molded "drop-in" one-piece unit to replace the standard cockpit of the J-24. The cockpit unit of fiberglass reinforced resin comprises redesigned curved or roll seating extending from the gunwale on each side beginning about 2' aft the mast. At the stern the seating extends within the transom to form a "U" configuration. By the redesign of the cockpit area, the new design increases the cockpit floor area by 255%, which affords greater comfort and maneuverability for the skipper and crew within the enlarged cockpit area. With the new cockpit the functionality of the boat changes from a Cruiser/Racer to a Day-Sailer/Racer by greatly sacrificing the deck covered interior volume to accommodate the enlarged cockpit area. Despite the removal of the old deck and replacement of the deck with the new cockpit unit and a new shorter deck, the deck and hull nevertheless accommodate the deck hardware as per the J-24 Class Rules which are of a strict one-design class.

DESCRIPTION OF THE PREFERRED EMBODIMENT

Figure 1A:
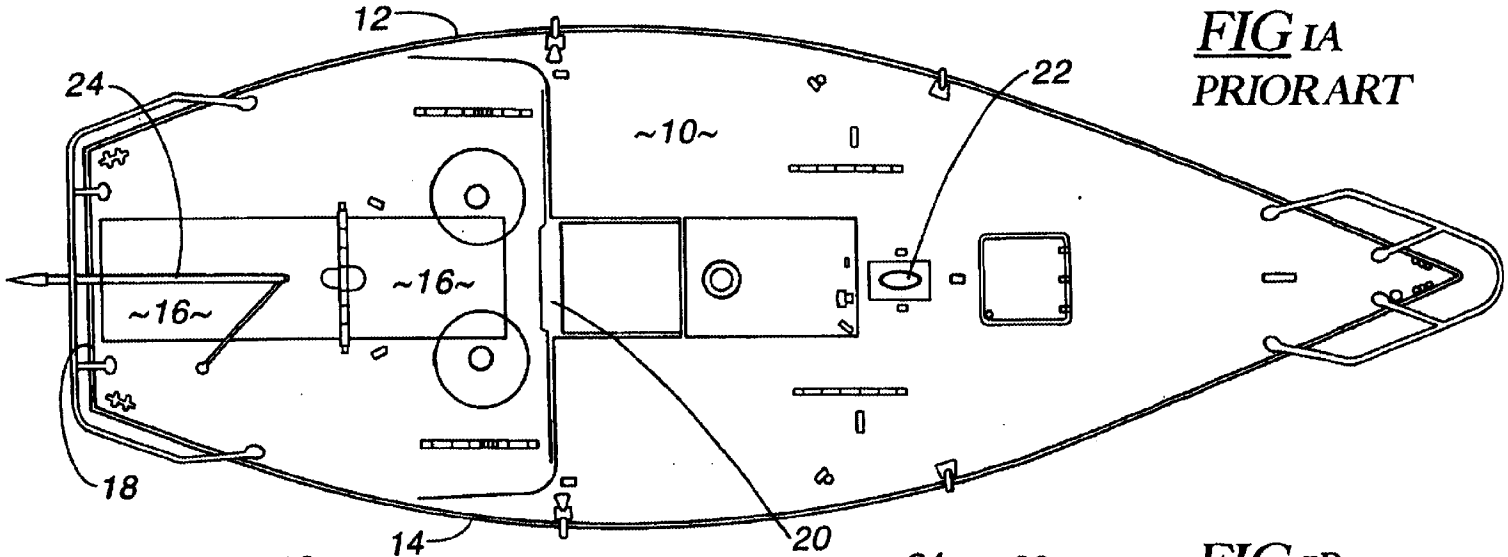
FIG 1A PRIOR ART
FIGS. 1A and 1B are plan views of the standard J-24 design and the new IC-24 design, respectively.

Illustrated in FIG. 1A is a J-24 plan view comprising an extensive deck area 10 extending between port 12 and starboard 14 gunwales. A small cockpit 16 extends forward from the transom 18 toward a companionway 20. The mast is indicated at 22 as is a tiller at 24.

Figure 1B:
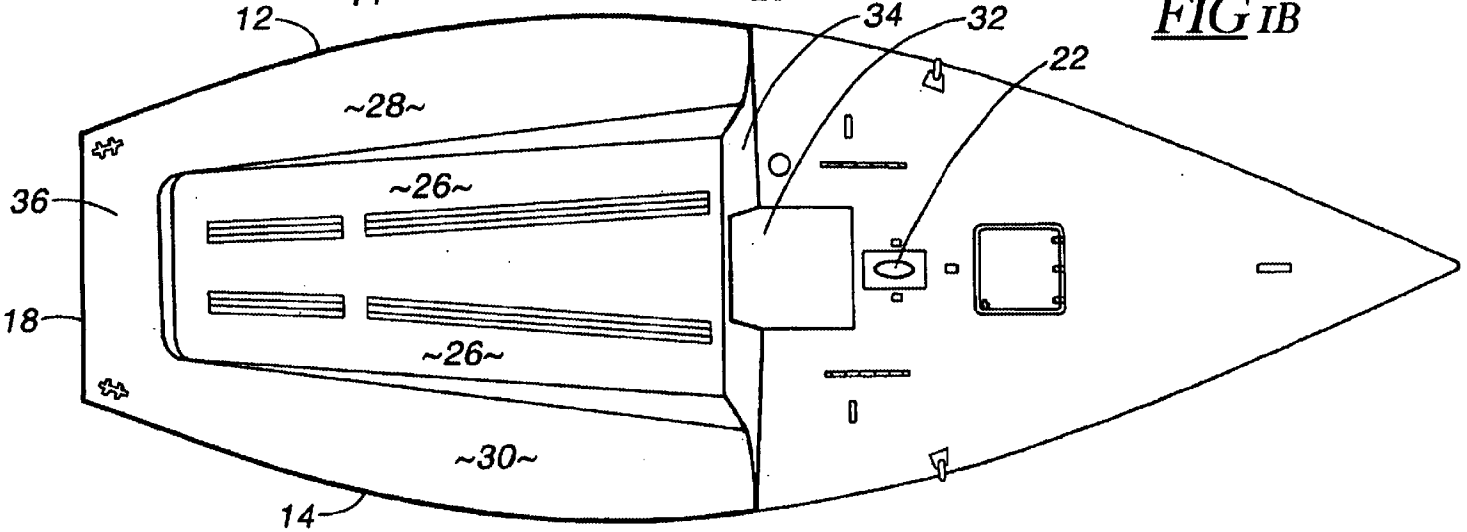

Illustrated in FIG. 1B is the same hull shape with port 12 and starboard 14 gunwales and mast 22. The cockpit floor 26 is considerably larger in the IC-24 as shown with seats 28 and 30 to either side rolling up to the port 12 and starboard 14 gunwales, respectively. The companionway 32 and companionway end 34 are considerably closer to the mast 22 and the floor 26 considerably longer and wider than in the old cockpit 16. The rolled seats 28 and 30 smoothly blend into a transom seat 36 at the stem.

Figure 2A:
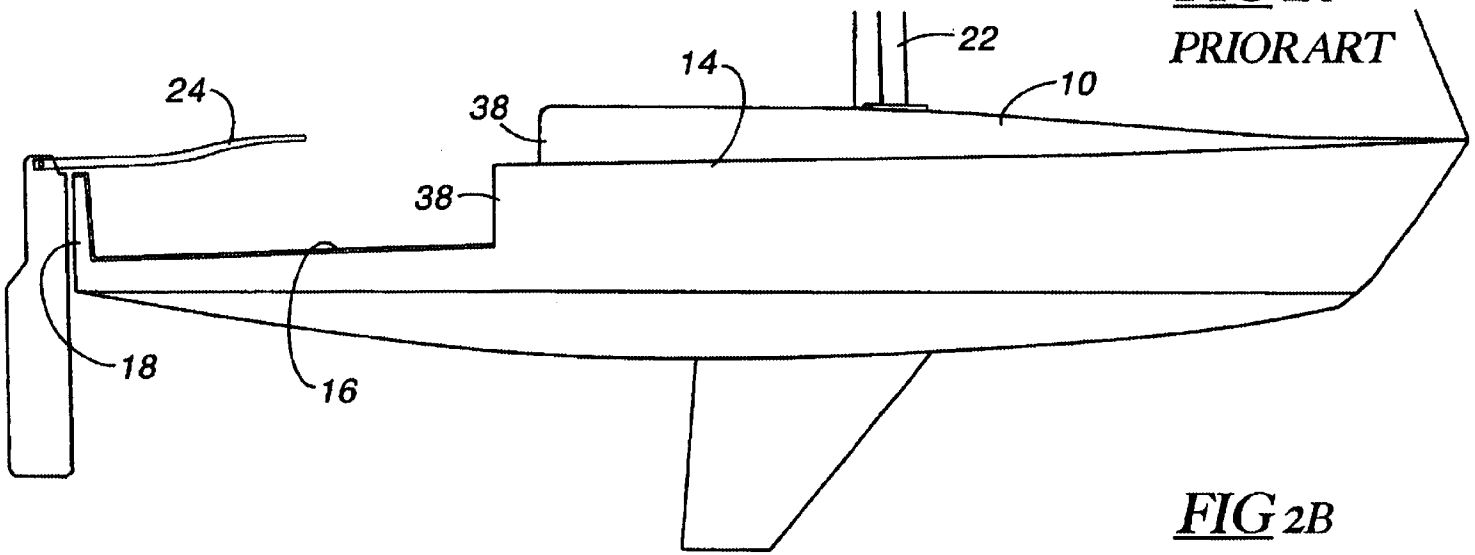
FIG 2A PRIOR ART
FIGS. 2A and 2B are longitudinal sections of the standard J-24 design and the new IC-24 design, respectively.
Figure 2B:
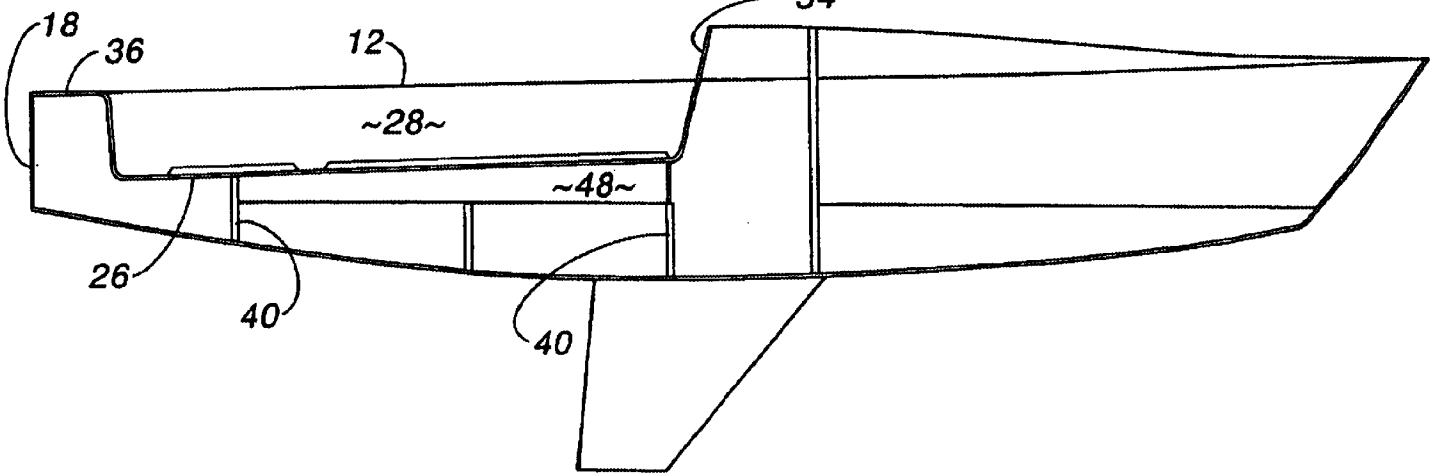

In elevation, as shown in FIGS. 2A and 2B, the increase in cockpit size through a centerline longitudinal section is very clear. As shown in FIG. 2A, the old cockpit floor 16 of the J-24 begins generally at the transom 18 and continues forward less than one-third the overall hull length to the old companionway end 38. In contrast, in FIG. 2B the IC-24 cockpit floor 26 begins forward of the new transom seat 36 and extends forward almost amidships to the new companionway end 34. The new cockpit floor 26 rests upon the bulkhead array 40 for support.

Figure 3B:
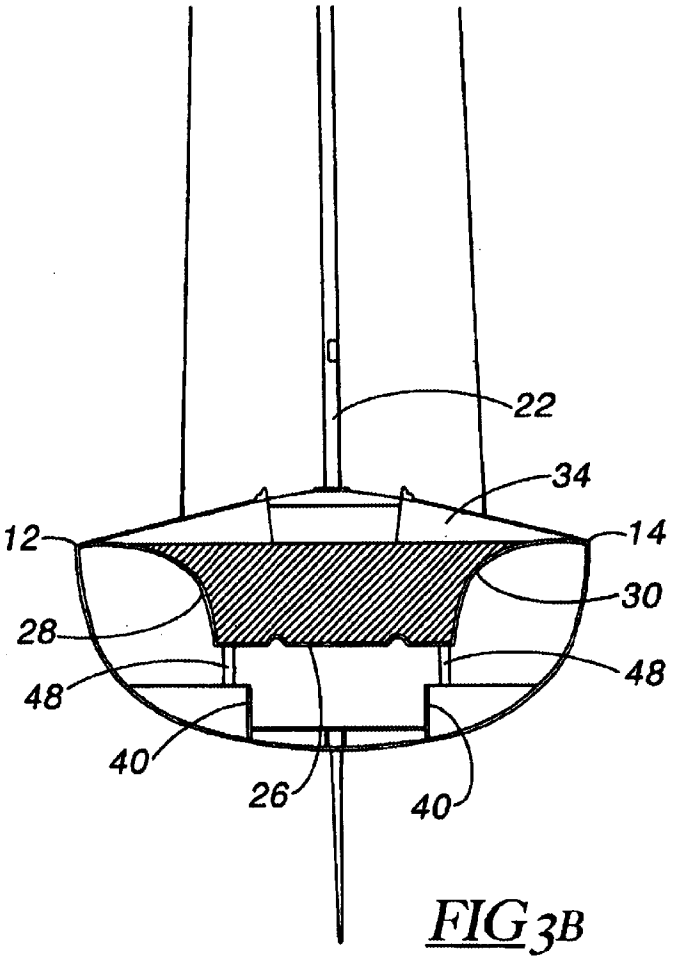
FIGS. 3A and 3B are lateral sections of the standard J-24 design and the new IC-24 design, respectively.
Figure 3A:
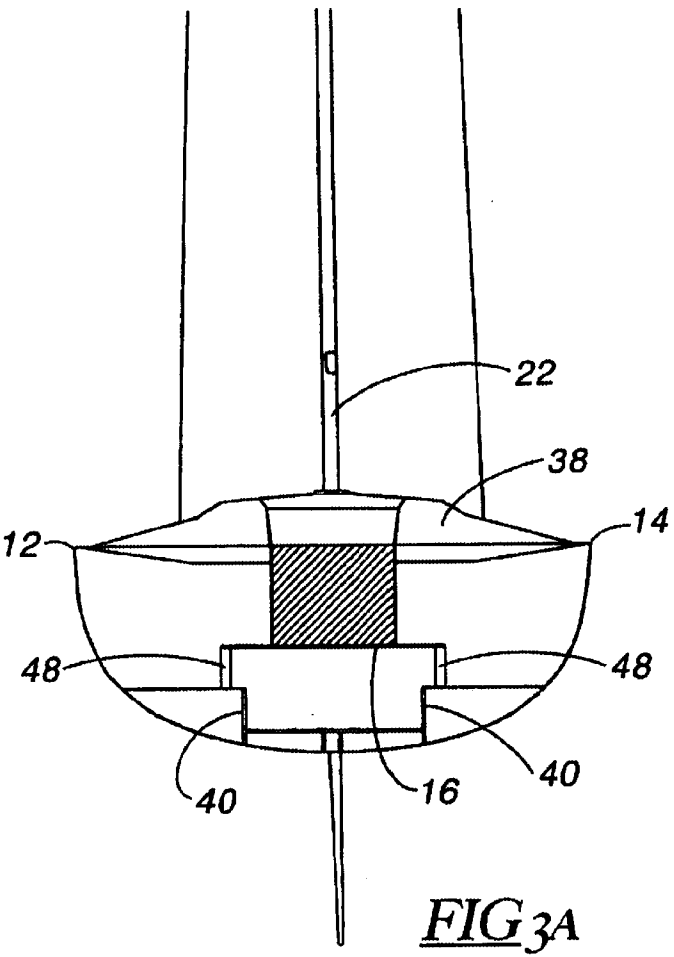
FIG 3A PRIOR ART
Figure 4:
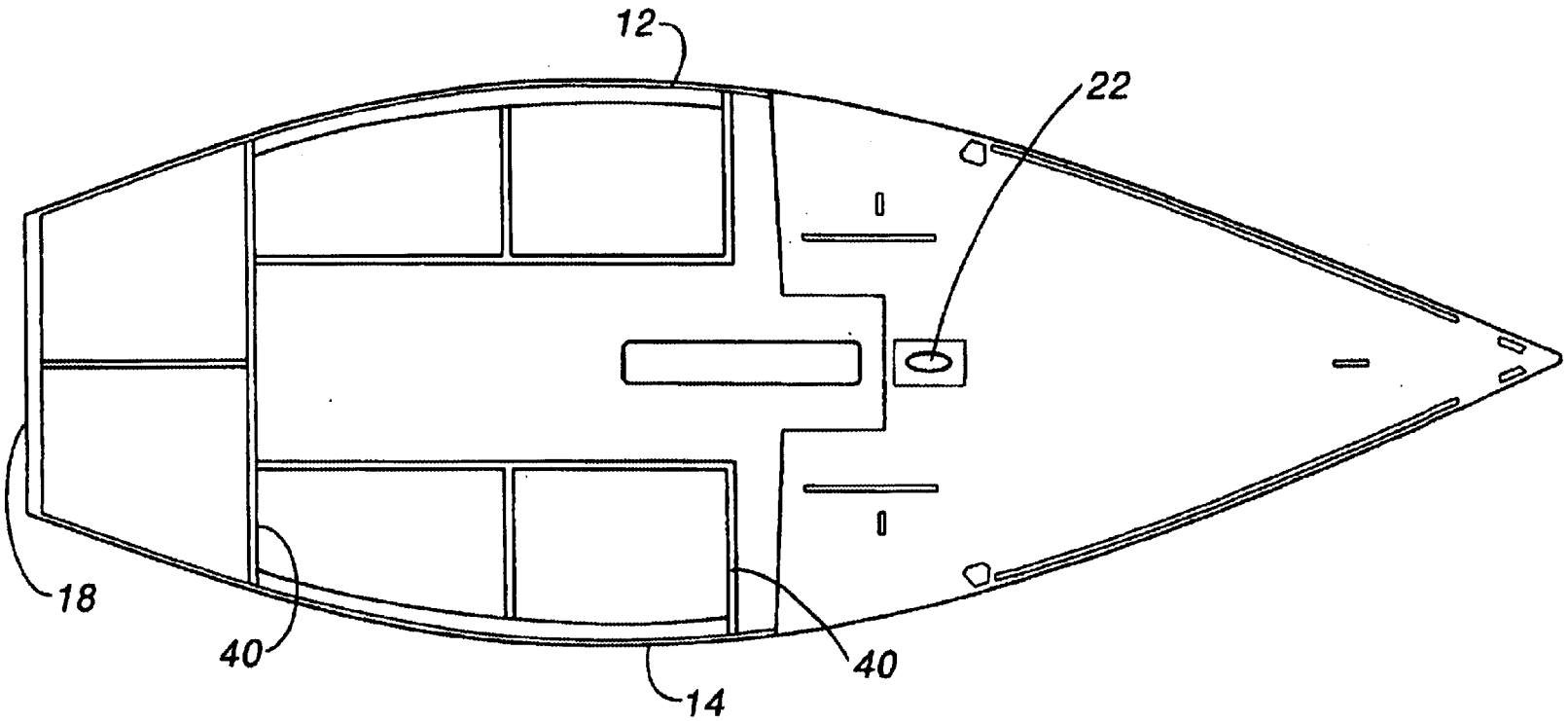
FIG. 4 is a plan view of the J-24 showing the bulkhead layout with the standard cockpit removed.

The transverse change in cockpit size is most dramatically shown in FIGS. 3A and 3B where the original cockpit floor 16 is about a quarter of the width of the boat and the new cockpit floor 26 is about one-half the width of the boat. Both the old cockpit floor 16 and the new cockpit floor 26 rest upon the existing bulkhead array 40. The bulkhead array 40 is shown in FIG. 4 wherein the bulkhead array provides ample support for the much longer and wider new cockpit floor 26.

Figure 5:
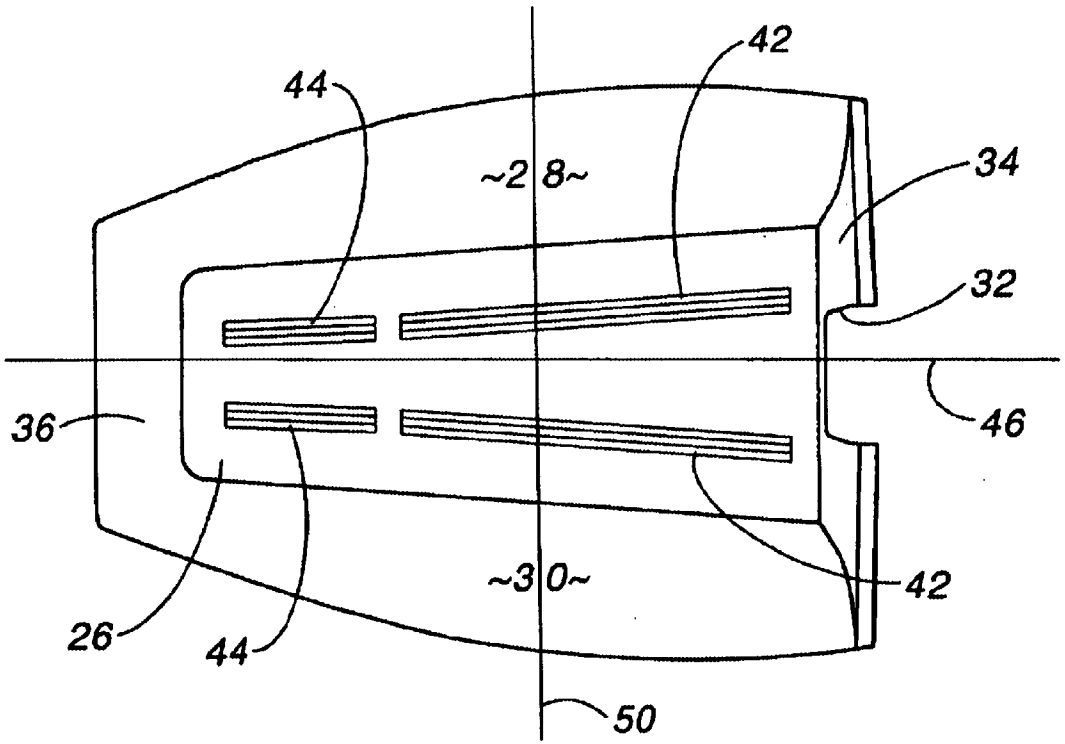
FIG. 5 is a plan view of the new IC-24 cockpit unit.

In FIG. 5, the new cockpit unit is a molded fiberglass and resin structure comprising the rolled seats 28 and 30, the cockpit floor 26, transom seat 36 and companionway end 34 with companionway 32 cut-out. Molded into the floor 26 are foot braces 42 and 44 spaced on each side of the cockpit centerline 46. The new cockpit unit drops into the open hull shown in FIG. 4 with the floor 26 resting upon longitudinal bulkhead members 48 shown in FIGS. 3A, 3B and FIG. 2B.

Figure 6A:
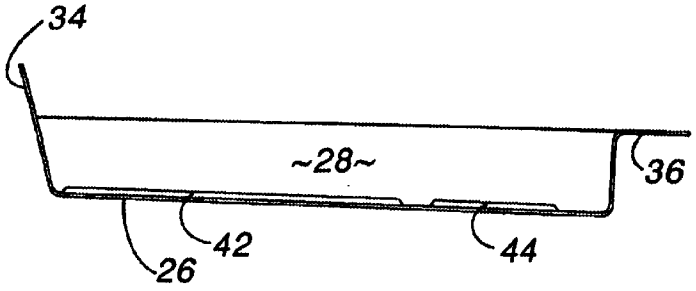
FIG. 6A is a side elevation of the cockpit unit.
Figure 6B:
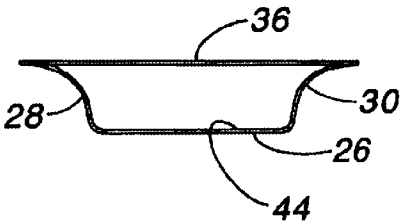
FIG. 6B is a transom end elevation of the cockpit unit.
Figure 6C:
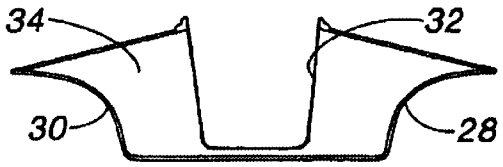
FIG. 6C is a companionway end elevation of the cockpit unit.

FIGS. 6A–6F illustrate various sections through the new cockpit. In FIG. 6A, the side elevation shows the seat 28, transom seat 36 at the right, companionway end 34 at the left, floor 26 and foot braces 42 and 44. FIG. 6B illustrates the transom seat 36, rolled seats 28 and 30, floor 26 and foot braces 44. Similarly, the companionway end 34 in FIG. 6C comprises the companionway 32, seats 28 and 30 and floor 26.

Figure 6D:
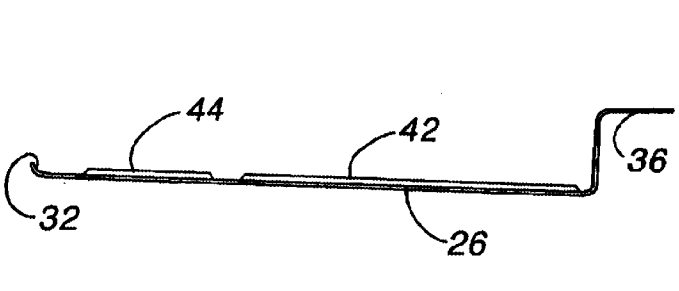
FIG. 6D is a section down the centerline of the cockpit unit.
Figure 6E:
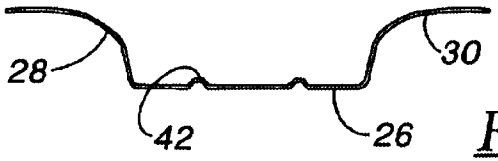
FIG. 6E is a transverse section of the cockpit unit.
Figure 6F:
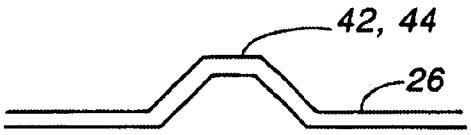
FIG. 6F is a detail of a foot brace.

FIG. 6D, taken along the centerline 46 in FIG. 5, illustrates the cockpit floor 26, transom seat 36, foot braces 42 and 44 and companionway 32 cut-out. FIG. 6E, taken along the lateral section 50 in FIG. 5, illustrates the rolled seats 28 and 30, floor 26 and foot braces 42. As shown in FIG. 6F, the foot braces 42 or 44 are substantially longitudinal elevated bumps in the cockpit floor 26 shaped to accommodate feet pushing against them.

Upon removal of the old cockpit and deck from a J-24, the new cockpit is dropped into position on the bulkhead array 40 and transom 18 and gunwales 12 and 14. A new smaller deck forward of the companionway end 34 is then installed, the hardware reattached and the IC-24 is ready for day sailing or racing.

What is claimed is:

1. The method of converting a cruising sailboat to a day-sailer by replacing the cockpit of the sailboat comprising the steps of:

removing the old cockpit and at least a portion of the old deck without substantially modifying the bulkhead-hull integrity, molding a new cockpit of greatly increased floor area and substantially changed seating, placing the new cockpit within the hull and upon the bulkhead array, and fastening, adhering and sealing the new cockpit to the bulkhead array and hull.

2. The method of claim 1, including the removal of the entire old deck and replacement with a substantially smaller deck.

3. The method of claim 1 wherein the step of molding a new cockpit comprises molding the new cockpit as a single unitary piece of fiberglass reinforced resin.

4. A replacement cockpit unit comprising a floor, rolled starboard and rolled port seats blending into a transom seat, a companionway end pierced by a companionway, and foot braces in the floor, all as a structural unit providing for greatly increased floor area in comparison with the cockpit replaced, and all in a one-design sailboat meeting class racing rules.

5. The replacement cockpit unit of claim 4 formed by a single fiberglass-resin composite.

6. The replacement cockpit unit of claim 4 wherein the transom seat is not rolled.

7. A replacement cockpit unit comprising a floor, starboard and port seats, a companionway end forward of the starboard and port seats and a transom end rearward of the starboard and port seats, all as a structural unit providing for greatly increased floor area in comparison with the cockpit replaced, and all in a one design sailboat meeting class racing rules.

8. The replacement cockpit unit of claim 7 wherein the floor area of the replacement cockpit unit provides about a 255% increase in cockpit floor area.

9. The replacement cockpit unit of claim 7, including integral foot braces molded in the floor.

10. The replacement cockpit unit of claim 7, including a transom seat integrally forming a part of the replacement cockpit.

11. The replacement cockpit unit of claim 7, including a companionway formed in the companionway end of the replacement cockpit.

12. The replacement cockpit unit of claim 7 wherein the starboard and port seats are rolled.

13. The replacement cockpit unit of claim 7, including a transom seat and rolled starboard and port seats, foot braces molded in the floor and a companionway formed in the companionway end.

14. The replacement cockpit unit of claim 13 wherein the replacement cockpit unit comprises a single formed fiberglass-resin composite.

15. The replacement cockpit unit of claim 7 wherein the replacement cockpit unit comprises a single formed fiberglass-resin composite.

16. The replacement cockpit unit of claim 7 wherein the replacement cockpit unit rests upon the existing bulkhead array in the sailboat.

* * * * *